US007207820B1

(12) United States Patent
Montena

(10) Patent No.: US 7,207,820 B1
(45) Date of Patent: Apr. 24, 2007

(54) CONNECTING ASSEMBLY FOR A CABLE AND METHOD OF CONNECTING A CABLE

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/346,981

(22) Filed: Feb. 3, 2006

(51) Int. Cl.
*H01R 13/52* (2006.01)

(52) U.S. Cl. ..... 439/275; 439/277; 439/320

(58) Field of Classification Search ..... 439/275, 439/322, 349, 584, 589, 578, 583, 277, 320
See application file for complete search history.

(56) References Cited

U.S. PATENT DOCUMENTS

| | | | | |
|---|---|---|---|---|
| 2,605,315 | A * | 7/1952 | Hargett | 439/275 |
| 3,622,939 | A * | 11/1971 | Forney, Jr. | 439/322 |
| 3,915,539 | A | 10/1975 | Collins | |
| 4,053,201 | A * | 10/1977 | Grappe | 439/589 |
| 4,173,385 | A * | 11/1979 | Fenn et al. | 439/277 |
| 4,296,986 | A * | 10/1981 | Herrmann, Jr. | 439/322 |
| 4,583,811 | A | 4/1986 | McMills | |
| 4,761,146 | A | 8/1988 | Sohoel | |
| 4,869,679 | A * | 9/1989 | Szegda | 439/272 |
| 5,435,751 | A | 7/1995 | Papenheim et al. | |
| 5,454,735 | A * | 10/1995 | Nelson | 439/578 |
| 5,667,405 | A * | 9/1997 | Holliday | 439/585 |
| 5,760,332 | A | 6/1998 | Rocci et al. | |
| 5,857,865 | A * | 1/1999 | Shimirak et al. | 439/277 |
| 6,069,320 | A | 5/2000 | Rocci et al. | |
| 6,095,858 | A | 8/2000 | Emery | |
| 6,264,503 | B1 | 7/2001 | Emery | |
| 6,929,265 | B2 * | 8/2005 | Holland et al. | 277/622 |
| 2005/0029807 | A1 * | 2/2005 | Montena | 285/151.1 |
| 2005/0176294 | A1 * | 8/2005 | Montena | 439/587 |
| 2005/0176296 | A1 * | 8/2005 | Montena | 439/587 |
| 2005/0181652 | A1 | 8/2005 | Montena et al. | |

* cited by examiner

*Primary Examiner*—Hae Moon Hyeon
(74) *Attorney, Agent, or Firm*—Wood, Phillips, Katz, Clark & Mortimer

(57) ABSTRACT

A connecting assembly has a first connector with a first connector part, a second connector with a second connector part, and a sealing assembly. The first and second connector parts are joinable to place the first and second connectors into a joined operative state wherein at least one conductive path is defined through the joined first and second connectors. The sealing assembly has at least one deformable component that is changeable from an assembly state into a sealed state by compression thereof with the first and second connectors in the operative state. The at least one deformable component defines a seal to block migration of moisture to between the first and second connector parts with the at least one deformable component in the sealed state.

37 Claims, 5 Drawing Sheets

CONNECTING ASSEMBLY FOR A CABLE AND METHOD OF CONNECTING A CABLE

BACKGROUND OF THE INVENTION

1. Field of the Invention

This invention relates to cables, such as coaxial cables, and, more particularly, to an assembly for connecting an end of a cable to either another cable end or a port, and including a sealing assembly to block moisture migration between connector parts.

2. Background Art

A myriad of assemblies are currently available for connecting a cable, such as a coaxial cable, to either another cable or a port, such as at a drop location. One of the most commonly utilized connecting structures in the cable industry includes a connector part in the form of a nut that is threadably engaged with a port, or another complementarily-threaded connector part.

In external environments, atmospheric moisture tends to migrate between the cooperating threads on the connector parts. This has a number of deleterious effects. First of all, the moisture may, over time, cause corrosion in the thread region, which may eventually make it difficult or impossible to separate the connector parts. This may preclude reuse of the connector parts.

The moisture and/or corrosion resulting therefrom may also interfere with the conductive properties through the connecting assembly, which may perform grounding and shielding functions. This may lead to electrical interference with high frequency signal transmissions.

Accordingly, the industry has devised a number of sealing assemblies with the objective of blocking migration of moisture to between connector parts.

A significant number of these sealing assemblies are operable by compressing a deformable component between cooperating surfaces on the connector parts, as an incident of the connector parts being operatively joined. One drawback with this type of system is that the connection between the connector parts may be compromised in order to adequately effect sealing. As one example, the sealing component(s) may prevent the optimal tightening torque to be applied between threadably engaged connector parts. An attempt to tighten to the optimal torque with the sealing assembly in place may damage or destroy the sealing assembly.

Often, these sealing assemblies utilize rubber washers to establish seals between inner connecting parts. These washers may not, however, block migration of moisture to between the threads in cooperating connector parts.

In the interest of speed and/or simplicity, installers may forego placement of washers and other separate components making up a sealing assembly, as a result of which the aforementioned problems may arise at the connecting assembly. However, even if installed properly, these sealing assemblies generally do not prevent moisture migration between cooperating threads on joined connector parts.

Heretofore, thread sealing has commonly been carried out by overwrapping joined connector parts with a special rubber tape or by using heat shrinking techniques. Generally, both these methods are costly and time consuming to practice. Further, they are only as effective as the installer who practices them is skilled and careful.

Ideally, a sealing assembly will be consistently used by installers, is not costly to employ, does not complicate or compromise installation, and effects a positive seal between the connector parts.

SUMMARY OF THE INVENTION

In one form, the invention is directed to a connecting assembly for a cable. The connecting assembly has a first connector with a first connector part, a second connector with a second connector part, and a sealing assembly. The first and second connector parts are joinable to place the first and second connectors into a joined operative state wherein at least one conductive path is defined through the joined first and second connectors between either: (a) first and second cable lengths operatively connected one each to the first and second connectors; or (b) a cable length operatively connected to one of the first and second connectors and a port with which the other of the first and second connectors is associated. The sealing assembly has at least one deformable component that is changeable from an assembly state into a sealed state with the first and second connectors in the operative state. The at least one deformable component defines a seal to block migration of moisture to between the first and second connector parts with the at least one deformable component in the sealed state. The at least one deformable component is compressed in changing between the assembly and sealed states.

In one form, the sealing assembly has at least one moving element, with the at least one moving element guided by at least one of the connector parts between first and second positions. The at least one deformable component is changed from the assembly state into the sealed state as an incident of the at least one moving element moving from the first position toward the second position with the first and second connectors in the joined operative state.

The joined first and second connector parts have a central axis. The at least one moving element may move axially between the first and second positions.

In one form, the at least one moving element is threadably connected to the at least one of the first and second connector parts and is movable guidingly relative to the least one of the first and second connector parts between the first and second positions.

In one form, the first connector part has external threads and the second connector part has internal threads. The first and second connector parts are joinable by mating the internal and external threads and relatively moving the first and second connector parts around the central axis.

In one form, the at least one moving element has a first shoulder facing axially in a first direction and the second connector part has a second shoulder facing axially oppositely to the first direction. The at least one deformable component resides between the first and second shoulders and is axially compressed as an incident of the least one moving element moving from the first position towards the second position.

In one form, the first connector part has an annular outside surface from which the external threads project, with the external threads having an effective diameter. The at least one deformable component has an annular inside surface that is slidable axially over the external threads with the at least one deformable component in the assembly state. The annular inside surface has an effective diameter that is less than the effective diameter of the external threads with the at least one deformable component in the sealed state, so that the annular inside surface is compressibly urged against a part of the annular outside surface that is spaced axially from the external threads to thereby effect sealing between the at least one deformable component and the part of the annular outside surface, with the at least one deformable component in the sealed state.

In one form, the part of the annular outside surface has contours and the at least one deformable component is conformed to the contours with the at least one deformable component in the sealed state.

In one form, the at least one deformable component has an annular member that is at least one of rubber and plastic.

The at least one moving element may be ring-shaped.

In one form, the at least one moving element is graspable by a user's fingers to be turned around the central axis to thereby move the at least one moving element from the first position towards the second position.

In one form, the at least one moving element is threadably connected to the second connector part and is movable guidingly relative to the second connector part to move the at least one moving element between the first and second positions.

The connecting assembly may be provided in combination with a coaxial cable operatively connected with one of the first and second connector parts.

The at least one moving element and at least one deformable component may be held together as a pre-assembled unit independently of the first and second connectors.

In one form, the at least one moving element is threadably connected to the second connector part and with the at least one moving element threadably connected to the second connector part, the first and second connector parts can be changed from a fully separated state into the joined operative state.

The at least one moving element may have a knurled surface that can be grasped by a user's fingers to facilitate turning of the at least one moving element around the central axis.

The invention is further directed to a connecting assembly for a cable, which connecting assembly has a first connector with a first connector part and a second connector with a second connector part. A sealing assembly has at least one deformable component having an assembly state and a sealed state. Structure cooperates between the first and second connector parts for joining and maintaining the first and second connectors in a joined operative state wherein at least one conductive path is defined through the joined first and second connectors between either: (a) first and second cable lengths operatively connected one each to the first and second connectors; or (b) a cable length operatively connected to one of the first and second connectors and a port with which the other of the first and second connectors is associated. Structure cooperates between the at least one deformable component and first and second connectors to cause the at least one deformable component to be changed from the assembly state into the sealed state with the first and second connectors in the operative state, to thereby define a seal to block migration of moisture to between the first and second connector parts.

In one form, structure cooperates between at least one of the connectors and the at least one deformable component to maintain the at least one of the connectors and at least one deformable component together as a unit with the first and second connectors fully separated from each other.

The invention is further directed to a sealing assembly for a cable connecting assembly. The sealing assembly has a ring-shaped moving element, having a central axis and a shoulder facing in a first axial direction, and a deformable component having an annular shape. The deformable component resides in a receptacle bounded by a radially inwardly facing surface and the shoulder so that the deformable component and ring-shaped moving element are maintained together as a unit. The ring-shaped moving element is guidingly movable axially relative to one connector to which the ring-shaped moving element is connected and that has a configuration to be joined into an operative relationship with another connector. The ring-shaped moving element causes the deformable component to be axially compressed between the shoulder and a part of one connector to which the ring-shaped element is connected, so as to thereby deform radially to sealingly engage another connector to which one connector to which the ring-shaped element is connected can be joined.

In one form, the ring-shaped moving element has threads to engage threads on one connector to which the ring-shaped moving element is connected.

The sealing assembly may be provided in combination with the one connector to which the ring-shaped moving element is connected.

In one form, the one connector has a part with internal threads to engage another connector and external threads to engage the threads on the ring-shaped moving element.

The deformable component may be made from at least one of rubber and plastic.

The sealing assembly may be further provided in combination with the another connector.

In one form, the deformable component, ring-shaped moving element, and one connector are maintained together as a unit with the one connector fully separated from the another connector.

The ring-shaped moving element may be movable around the central axis relative to the one connector to thereby axially compress the deformable component.

In one form, the deformable component has an annular inside surface with an effective diameter that is variable as an incident of the ring-shaped moving element being moved around the central axis relative to the one connector.

The sealing assembly may be further provided in combination with a coaxial cable operatively connected to one of the one and the another of the connectors.

The invention is further directed to a method of connecting a cable. The method includes the steps of: providing a first connector with a first connector part; providing a sealing assembly on the first connector and having a moving member and a deformable component; operatively connecting a cable to the first connector so that a conductive path is defined through the cable and to the first connector; providing a second connector with a second connector part; joining the first and second connector parts to thereby place the first and second connectors into a joined operative state and thereby extend the conductive path to the second connector; and with the first and second connectors in the operative state, moving the moving member to cause the deformable component to seal between the first and second connector parts.

The step of providing a sealing assembly may involve providing a sealing assembly with a moving member that is threadably connected to the first connector part, with the step of moving the moving member involving turning the moving member around an axis relative to the first connector part.

The step of moving the moving member to cause the deformable component to seal may involve moving the moving member to compress the deformable component between the moving member and the first connector part.

The step of joining the first and second connector parts may involve joining the first and second connector parts with the first and second connector parts initially fully separated from each other and the sealing assembly maintained on the first connector.

In one form, the second connector has an annular outside surface from which threads project and a part with contours spaced from the threads. The first connector has threads to engage the threads on the second connector to maintain the first and second connectors in a joined operative state. The step of moving the moving member involves moving the moving member to cause the deformable component to conform to the contours on the part of the annular outside surface.

The step of providing a sealing assembly may involve providing a sealing assembly with a deformable component made from at least one of plastic and rubber.

The step of providing a sealing assembly may involve providing a sealing assembly with a ring-shaped moving member.

The step of providing a sealing assembly may involve providing a sealing assembly with a ring-shaped moving member having a knurled surface, with the step of moving the moving member involving grasping the moving member at the knurled surface between a plurality of fingers and turning the moving member around an axis.

DETAILED DESCRIPTION OF THE DRAWINGS

Figure 1:
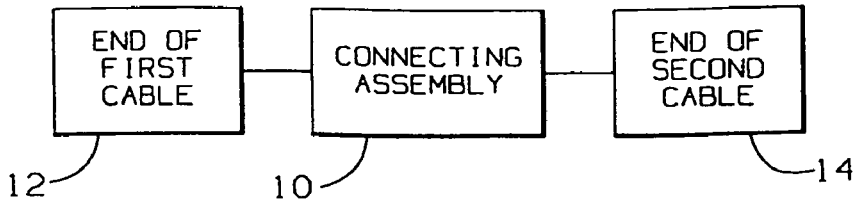
FIG. 1 is a schematic representation of one form of connecting assembly, according to the present invention, through which a conductive path is defined between cable ends.

In FIG. 1, a connecting assembly 10, according to the present invention, is shown in schematic form to generically represent structures contemplated by the invention. The connecting assembly 10 is utilized to connect between the end 12 of a first cable and the end 14 of a second cable, to define at least one conductive path through the connecting assembly 10 between lengths of the first and second cables.

Figure 2:
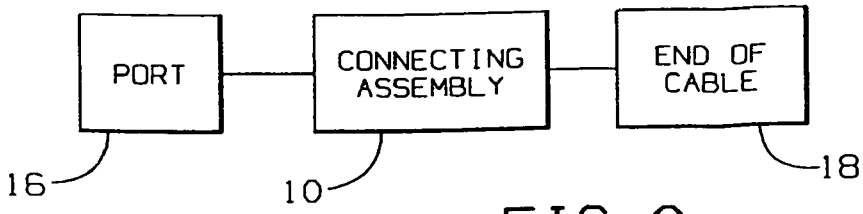
FIG. 2 is a schematic representation, as in FIG. 1, wherein the connecting assembly defines a conductive path between a cable and a port.

In an alternative environment, as shown in FIG. 2, the connecting assembly 10 is connected to a port 16 to define at least one conductive path through the connecting assembly 10 between the end 18 of a cable and the port 16.

The cables, in each instance in FIGS. 1 and 2, may be of a construction to define a single conductive path, or multiple, independent conductive paths. In the latter case, the connecting assembly 10 can be used with a coaxial cable for a limitless number of different applications, corresponding to those shown generically in FIGS. 1 and 2.

One specific form of the connecting assembly 10 is shown in FIGS. 3–6. The connecting assembly 10 shown consists of a first, female connector 22 with a first connector part 24, and a second, male connector 26 with a second connector part 28. The connecting assembly 10 further includes a sealing assembly at 30, consisting of at least one deformable component 32 and at least moving element 34.

The first connector 22 defines two independent, conductive paths for separate conductors 36, 38 on a cable 40 or port 16 with which the first connector 22 is associated.

The second connector 26 likewise defines two independent, conductive paths for separate conductors 36',38', associated with the cable 40'.

Figure 5:
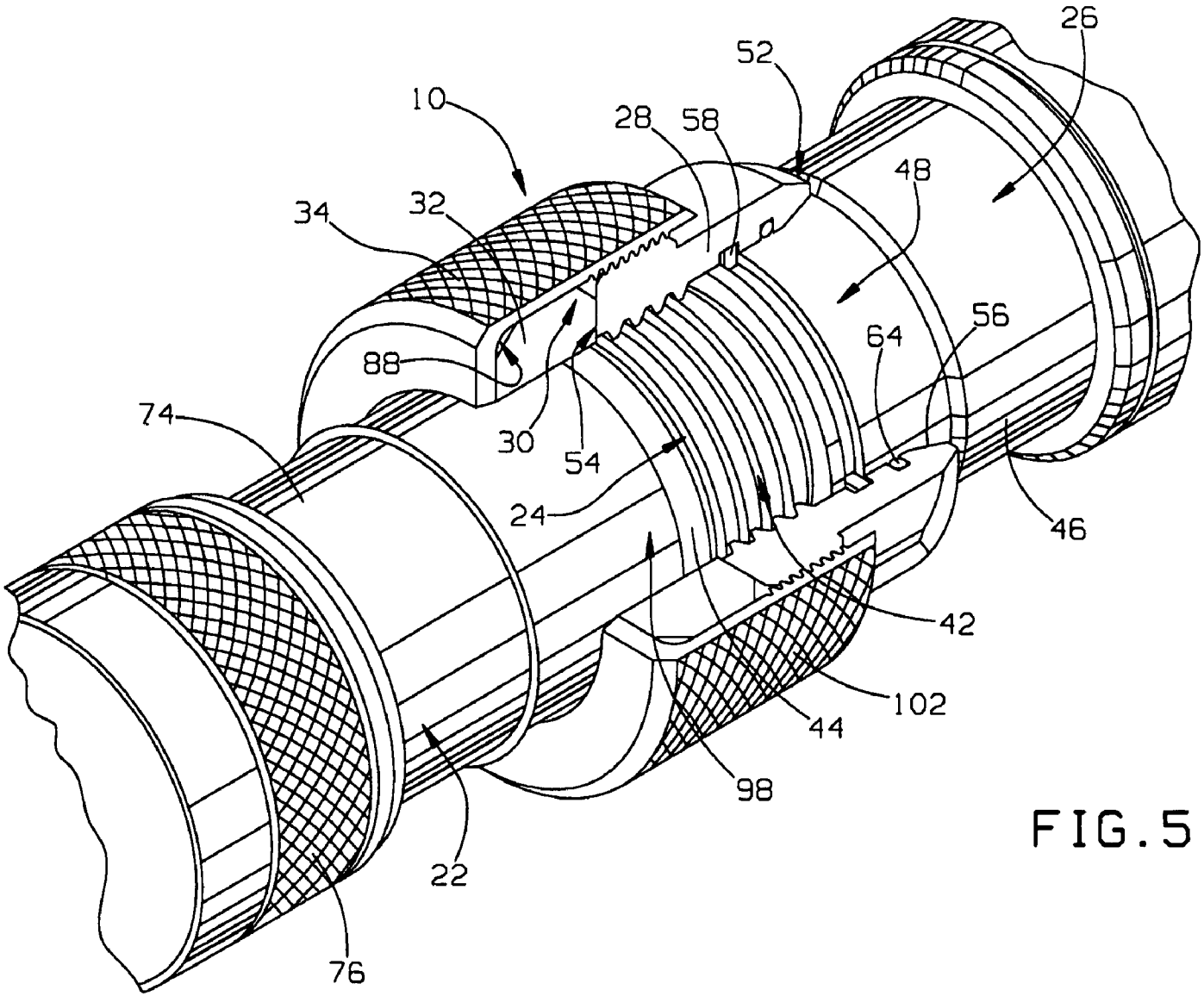
FIG. 5 is a view as in FIG. 4 wherein the connectors are joined into an operative state and wherein a deformable component on the sealing assembly is placed in a preliminary assembly state.
Figure 6:
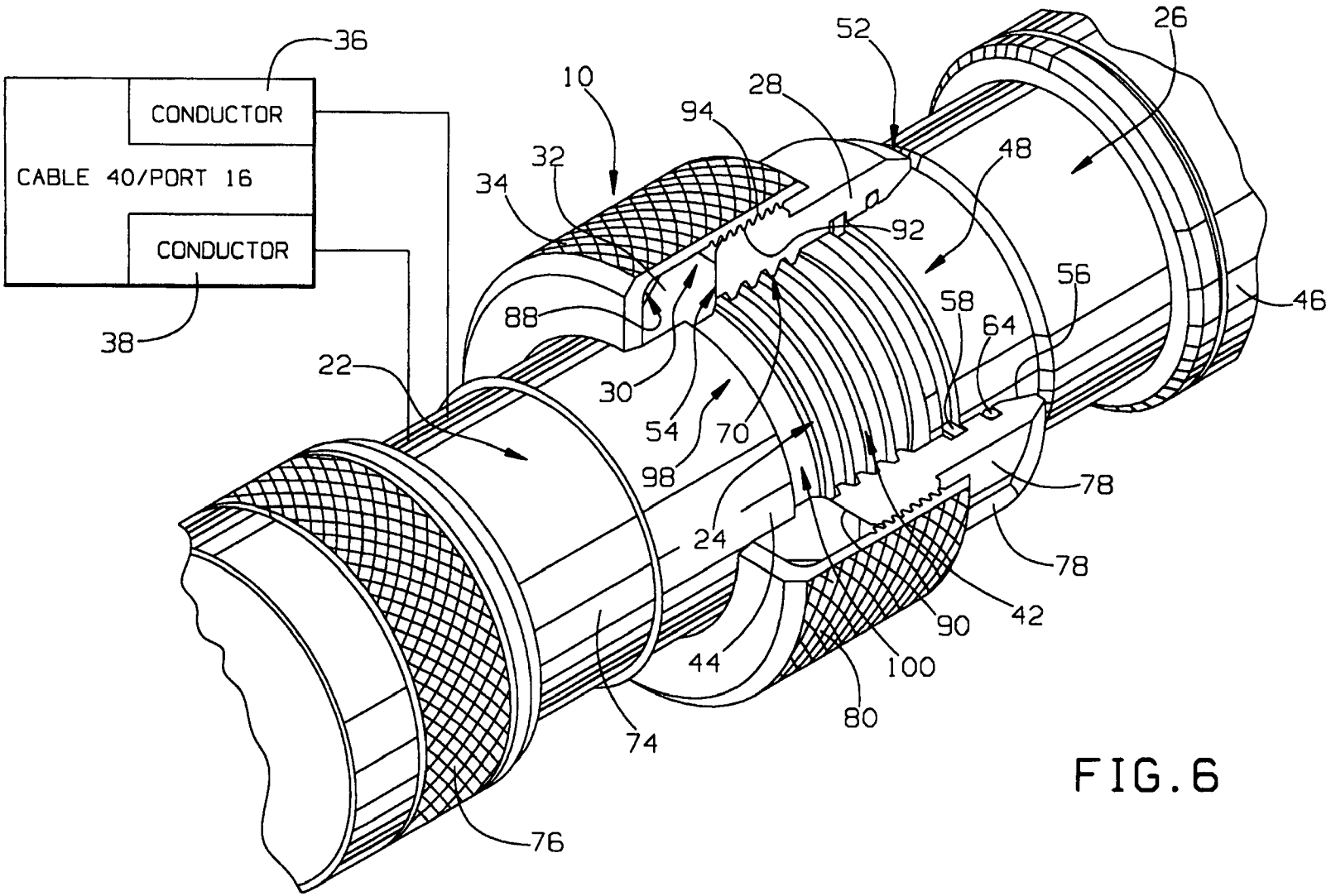
FIG. 6 is a view as in FIG. 5 wherein the sealing assembly is changed to a state wherein the deformable component is in a sealed state, compressed between the first and second connectors.

With the connectors 22,26 joined into an operative state, as shown in FIGS. 5 and 6, separate conductive paths are defined through the first and second connectors 22,26 between the conductors 36,36' and 38,38'.

The precise nature of the cable and the components thereon that interact with the connectors 22,26 joined into the operative state is not critical to the present invention. The many possible configurations thereof are well known to those skilled in this art. Thus, a detailed description of these components will not be provided herein.

In the exemplary embodiment, the first connector part 24 consists of external threads at 42 projecting from an annular, outside surface 44 on the first connector 22. The threads 42 project to define an effective diameter that is slightly greater than the diameter of the surface 44.

The second connector 26 has a main body 46 with a tapered end 48 at which the connector part 28 is surroundingly attached for rotation relative to the main body 46 around a central axis 50. The second connector part 28 functions as a securing nut and has axially spaced ends 52,54.

At the axial end 52, the second connector part 28 has a radially inwardly facing surface 56 that conforms to the tapered end 48 of the main body 46. A locking ring 58 extends into an undercut, radially outwardly opening groove 60 in the body 46, and a radially inwardly opening groove 62 through the surface 56. With this arrangement, the relative axial positions of the second connector part 28 and body 46 are fixed, while allowing the second connector part 28 to rotate guidingly relative to the body 46 around the central axis 50.

An O-ring 64 resides within a radially inwardly opening groove 66 through the inwardly facing surface 56 on the second connector part 28. The O-ring 64 is compressed between the radially inwardly facing surface 68, at the base of the groove 66, and the tapered end 48 to establish and maintain a seal between the second connector part 28 and body 46 as relative movement occurs therebetween around the axis 50.

At the axial end 54, the second connector part 28 has internal threads 70 that are complementary to the external threads 42 on the connector 22. The threads 42,70 can be engaged by aligning the central axis 50 of the connector 26 with the central axis 72 of the connector 22 and thereafter axially moving the connectors 22,26 towards and against each other. A body 74 on the first connector 22 can be either fixed, or held as through a knurled outer surface 76, while turning the connector part 28 around the aligned axes 50,72.

Flats 78 are provided on the connector part 28 to produce a polygonal shape that can be engaged by a conventional wrench to effect turning of the connector part 28 around the axes 50,72. Tightening can be effected by exerting a predetermined torque on the connector part 28 that produces the optimum connection between the threads 42,70 on the connector parts 24,28, respectively, thereby placing and releasably fixedly maintaining the first and second connectors 22,26 in the joined operative state whereby the first and second connectors 22, 26 are prevented from being separated by the application of forces on the connectors 22, 26 in axial opposite directions.

According to the invention, the operation of the sealing assembly 30 takes place preferably after the connectors 22,26 are placed, and releasably fixedly maintained by the cooperation between the connector parts 24, 28, in their joined, operative state, independently of the sealing assembly 30. Accordingly, this makes possible the mechanical connection between the connector parts 24,28 without any interference from the sealing assembly 30.

The sealing assembly 30, consisting of the moving element 34 and deformable component 32, may be preassembled as a unit that is pre-attached to the second connector part 28, though this is not a requirement. The moving element 34 is preferably ring-shaped and has an annular body 80 from which an integral, radially inwardly projecting wall 82 extends. The wall 82 has an axially facing surface/shoulder 84. The body 80 has a radially inwardly facing, annular surface 86. The surface/shoulder 84 and surface 86 cooperatively define a receptacle 88 for the deformable component 32 which can be pressed into, and frictionally held, therewithin.

With the sealing assembly 30 operatively placed on the second connector 26, the deformable component 32 resides between the surface/shoulder 84, which faces in a first axial direction, and a surface/shoulder 90 at the end 54 of the second connector part 28, that faces axially oppositely thereto.

The moving element 34 is maintained on, and movable relative to, the connector part 28 by cooperating threads 92,94, with the former internal threads on the radially inwardly facing surface 86 of the moving element 34, and the latter external threads at the axial end 54 of the second connector part 28.

Figure 3:
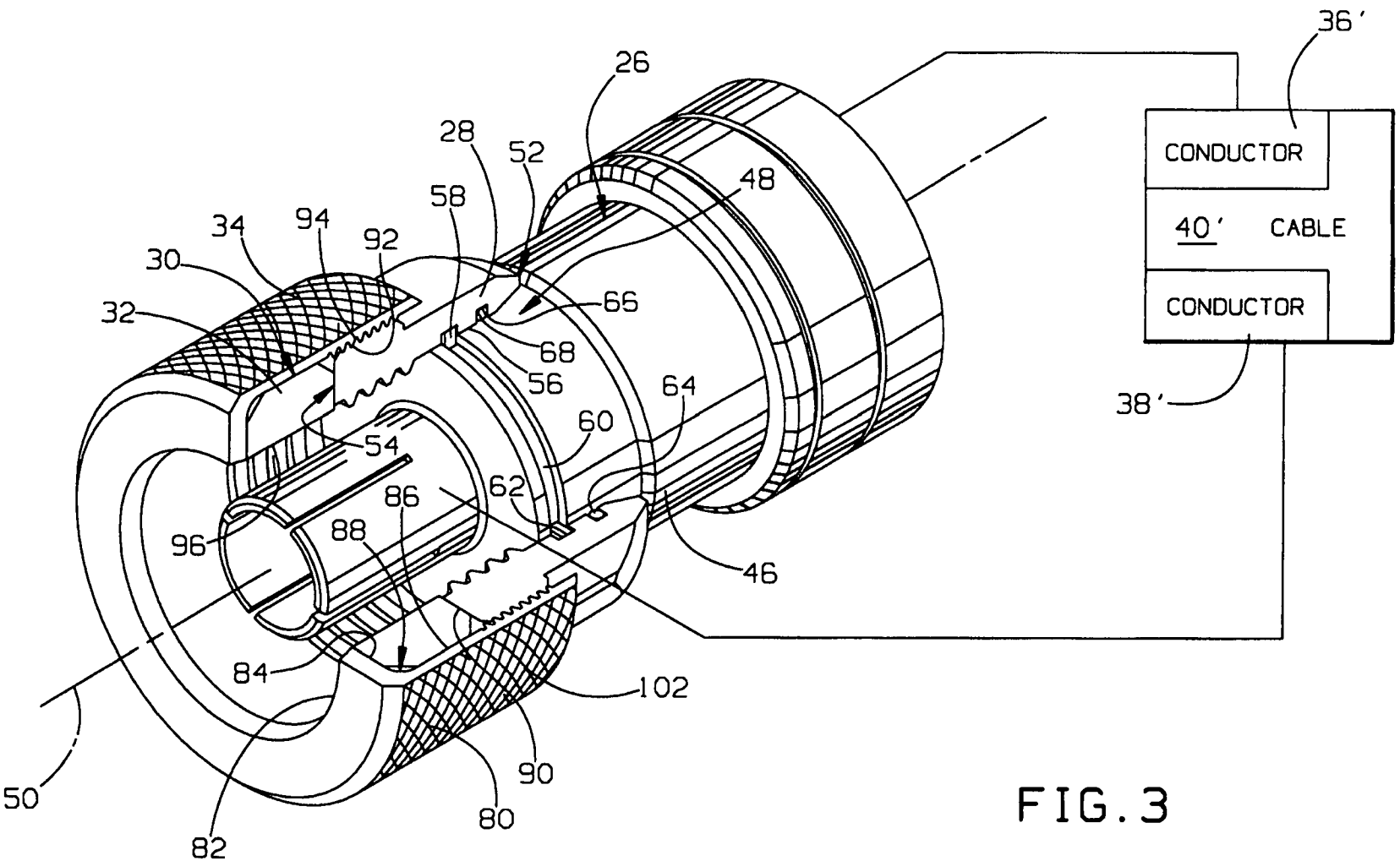
FIG. 3 is a partially broken away, perspective view of a specific form of connector on the connecting assembly in FIGS. 1 and 2, and including a sealing assembly, according to the present invention.

The threads 92,94 have an axial extent which permit the moving element 34 to be moved axially by turning from a first position, as shown in FIG. 3, wherein the deformable component 32 is loose or only slightly compressed between the surfaces/shoulders 84,90, into a second position, as shown in FIG. 6, wherein the deformable component 32 is compressed between the surfaces/shoulders 84,90.

By turning the moving element 34 in one direction of rotation around the axes 50,72, the cooperating threads 92,94 cause the moving element 34 to advance from left to right relative to the pre-tightened connector part 28. This turning action diminishes the spacing between the surfaces/shoulders 84,90. The connector part 28 is preferably pre-torqued sufficiently that there is no tendency for the connector part 28 to release from the connector part 24 as this occurs.

Initially, with the moving element 34 in the first position therefor, the deformable component 32 is in an assembly state, wherein an annular inside surface 96 thereon has an effective diameter that is approximately equal to, or slightly greater than, the effective diameter of the threads 42. This allows the deformable component 32 to be slid axially up to and over the threads 42 to allow the connector parts 24,28 to be threadably engaged and tightened, one against the other, whereupon the deformable component 32 is shifted axially to reside at a part 98 of the surface 44 located axially beyond the threads 42. The surface part 98 has contours at 100 adjacent to the threads 42.

By thereafter turning the moving element 34 around the axes 50,72 in the aforementioned one direction, the moving element 34 is shifted from left to right in FIGS. 3–6 relative to the connector part 28, thereby diminishing the distance between the surfaces/shoulders 84,90. This results in an axial compression of the deformable component 32. This compressing action forces the deformable component 32 to expand radially so as to conform to the contours 100 in the surface 44, to effect a positive seal therearound. Thus, the inside surface 96 of the deformable component 32 seals positively around the connector surface 44 and also positively axially against the surface/shoulder 90 so that there is no path for migration of moisture to in-between the threads 42,70.

By reason of the ring-shaped construction of the moving element 34, it is easily manipulated by a user, as between a user's fingers. The outer surface 102 of the annular body 80 may be knurled to facilitate gripping and, in an alternative form, the outer surface 102 may be configured to accommodate a conventional-type tool.

Figure 4:
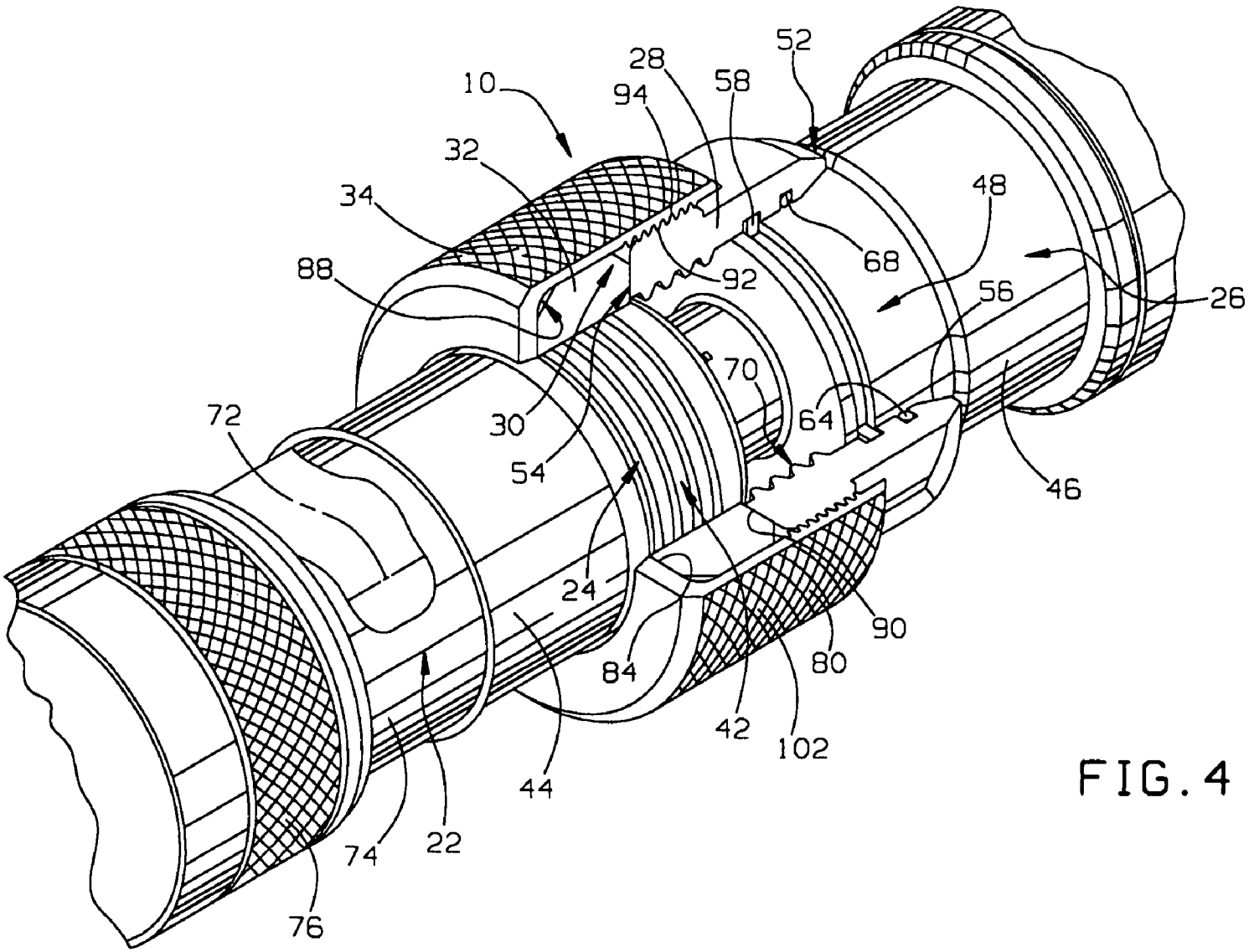
FIG. 4 is a view as in FIG. 3 wherein the connector in FIG. 3 is presented to be joined to another connector defining the connecting assembly in FIGS. 1 and 2.

As noted above, the sealing assembly 30 does not interfere with the basic connection of the connector parts 24,28. Once this connection is effected to place the connectors 22,26 in their joined operative state, the sealing assembly 30 can be turned by hand, or using a tool, to thereby change the annular deformable component 32 from its assembly state, as shown in FIGS. 3–5, into its sealed state, as shown in FIG. 6.

With the inventive concepts in hand, many variations from the basic structure described herein would be obvious to those skilled in the art. For example, the location of the internal and external threads is not limited to what is shown in the drawings. The moving element 34 could be connected to the connector part 22 to cooperate therewith to function in the same manner as described hereinabove.

Figure 7:
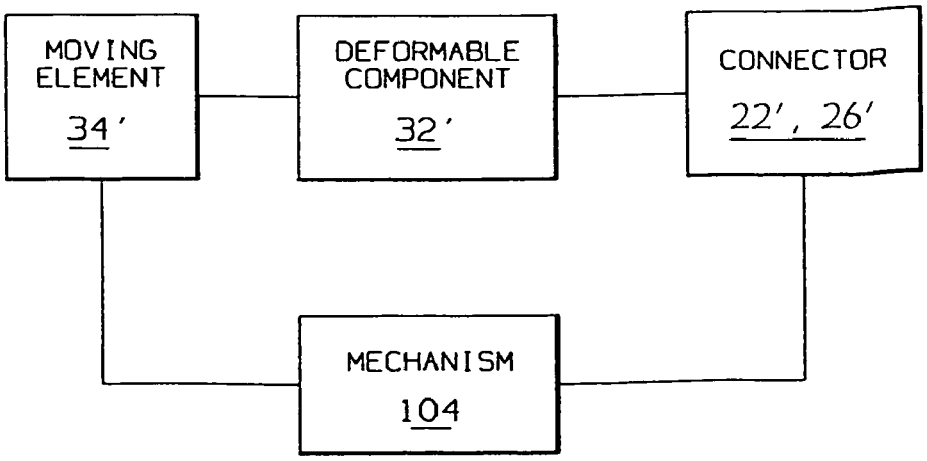
FIG. 7 is a schematic representation of a generic form of sealing assembly, according to the present invention.

As a further alternative, as shown in FIG. 7, the deformable component 32' may be changed between corresponding assembly and sealed states by repositioning a moving element 34' relative to a connector 26',28' through any other mechanism 104 that is an alternative to cooperating threads. For example, a bayonet-type connection may be used for this purpose or a mechanism using relatively movable and frictionally held components may be utilized and can be operated either by hand or through a tool.

As noted above, the sealing assembly 30 can be preassembled to the connector 26. Alternatively, the sealing assembly 30 could be preassembled to the connector 22 and slid axially therealong to threadably engage the connectors 22,26, once in their joined, operative state.

While the invention has been described with particular reference to the drawings, it should be understood that various modifications could be made without departing from the spirit and scope of the present invention.

The invention claimed is:

1. A connecting assembly for a cable, the connecting assembly comprising:

a first connector with a first connector part;

a second connector with a second connector part, the first and second connector parts joinable to place the first and second connectors into a joined operative state wherein at least one conductive path is defined through the joined first and second connectors between either: (a) first and second cable lengths operatively connected one each to the first and second connectors; or (b) a cable length operatively connected to one of the first and second connectors and a port with which the other of the first and second connectors is associated; and a sealing assembly, the sealing assembly comprising at least one deformable component that is changeable from an assembly state into a sealed state with the first and second connectors in the operative state, the at least one deformable component defining a seal to block migration of moisture to between the first and second connector parts with the at least one deformable component in the sealed state, the at least one deformable component compressed in changing between the assembly and sealed states, the first and second connector parts cooperating with each other to releasably fixedly maintain the first and second connectors in the joined operative state independently of the sealing assembly.

2. The connecting assembly according to claim 1 wherein the sealing assembly comprises at least one moving element, the at least one moving element guided by at least one of the connector parts between first and second positions, the at least one deformable component changed from the assembly state into the sealed state as an incident of the at least one moving element moving from the first position toward the second position with the first and second connectors in the operative state.

3. The connecting assembly according to claim 2 wherein the joined first and second connector parts have a central axis and the at least one moving element moves axially between the first and second positions.

4. The connecting assembly according to claim 3 wherein the at least one moving element is threadably connected to the at least one of the first and second connector parts and is movable guidingly relative to the at least one of the first and second connector parts between the first and second positions.

5. The connecting assembly according to claim 4 wherein the at least one moving element is graspable by a user's fingers to be turned around the central axis to thereby move the at least one moving element from the first position towards the second position.

6. The connecting assembly according to claim 2 wherein the at least one moving element and at least one deformable component are held together as a pre-assembled unit independently of the first and second connectors.

7. The connecting assembly according to claim 6 wherein the at least one moving element is threadably connected to the first connector part and with the at least one moving element threadably connected to the first connector part, the first and second connectors can be changed from a fully separated state into the operative state.

8. The connecting assembly according to claim 1 in combination with a coaxial cable operatively connected with one of the first and second connector parts.

9. A connecting assembly for a cable, the connecting assembly comprising:

a first connector with a first connector part;

a second connector with a second connector part, the first and second connector parts joinable to place the first and second connectors into a joined operative state wherein at least one conductive path is defined through the joined first and second connectors between either: (a) first and second cable lengths operatively connected one each to the first and second connectors; or (b) a cable length operatively connected to one of the first and second connectors and a port with which the other of the first and second connectors is associated; and a sealing assembly, the sealing assembly comprising at least one deformable component that is changeable from an assembly state into a sealed state with the first and second connectors in the operative state, the at least one deformable component defining a seal to block migration of moisture to between the first and second connector parts with the at least one deformable component in the sealed state, the at least one deformable component compressed in changing between the assembly and sealed states, wherein the sealing assembly comprises at least one moving element, the at least one moving element guided by at least one of the connector parts between first and second positions, the at least one deformable component chanced from the assembly state into the sealed state as an incident of the at least one moving element moving from the first position toward the second position with the first and second connectors in the operative state, wherein the joined first and second connector parts have a central axis and the at least one moving element moves axially between the first and second positions, wherein the at least one moving element is threadably connected to the at least one of the first and second connector parts, wherein the first connector part has external threads, the second connector part has internal threads, the first and second connector parts joinable by mating the internal and external threads and relatively moving the first and second connector parts around the central axis.

10. The connecting assembly according to claim 9 wherein the at least one moving element is threadably connected to the first connector part and is movable guidingly relative to the second connector part to move the at least one moving element between the first and second positions.

11. A connecting assembly for a cable, the connecting assembly comprising:

a first connector with a first connector part;

a second connector with a second connector part, the first and second connector parts joinable to place the first and second connectors into a joined operative state wherein at least one conductive path is defined through the joined first and second connectors between either: (a) first and second cable lengths operatively connected one each to the first and second connectors; or (b) a cable length operatively connected to one of the first and second connectors and a port with which the other of the first and second connectors is associated; and a sealing assembly, the sealing assembly comprising at least one deformable component that is changeable from an assembly state into a sealed state with the first and second connectors in the operative state, the at least one deformable component defining a seal to block migration of moisture to between the first and second connector parts with the at least one deformable component in the sealed state, the at least one deformable component compressed in changing between the assembly and sealed states, wherein the sealing assembly comprises at least one moving element, the at least one moving element guided by at least one of the connector parts between first and second positions, the at least one deformable component changed from the assembly state into the sealed state as an incident of the at least one moving element moving from the first position toward the second position with the first and second connectors in the operative state, wherein the joined first and second connector parts have a central axis and the at least one moving element moves axially between the first and second positions, wherein the at least one moving element is threadably connected to the at least one of the first and second connector parts, wherein the first connector part has external threads, the second connector part has internal threads, the first and second connector parts joinable by mating the internal and external threads and relatively moving the first and second connector parts around the central axis, wherein the at least one moving element has a first shoulder facing axially in a first direction, the second connector part has a second shoulder facing axially oppositely to the first direction, and the at least one deformable component resides between the first and second shoulders and is axially compressed as an incident of the least one moving element moving from the first position towards the second position.

12. The connecting assembly according to claim 11 wherein the first connector part has an annular outside surface from which the external threads project, the external threads having an effective diameter, and the at least one deformable component has an annular inside surface, the annular inside surface slidable axially over the external threads with the at least one deformable component in the assembly state, the annular inside surface having an effective diameter that is less than the effective diameter of the external threads with the at least one deformable component in the sealed state so that the annular inside surface is compressibly urged against a part of the annular outside surface that is spaced axially from the external threads to thereby effect sealing between the at least one deformable component and the part of the annular outside surface with the at least one deformable component in the sealed state.

13. The connecting assembly according to claim 12 wherein the part of the annular outside surface has contours and the at least one deformable component is conformed to the contours with the at least one deformable component in the sealed state.

14. The connecting assembly according to claim 12 wherein the at least one deformable component comprises an annular member comprising at least one of rubber and plastic.

15. The connecting assembly according to claim 14 wherein the at least one moving element is ring-shaped.

16. The connecting assembly according to claim 15 wherein the at least one moving element has a knurled surface that can be grasped by a user's fingers to facilitate turning of the at least one moving element around the central axis.

17. A connecting assembly for a cable, the connecting assembly comprising:

a first connector with a first connector part;

a second connector with a second connector part;

a sealing assembly comprising at least one deformable component having an assembly state and a sealed state;

means cooperating between the first and second connector parts independently of the sealing assembly for joining and maintaining the first and second connectors in a joined operative state wherein at least one conductive path is defined through the joined first and second connectors between either: (a) first and second cable lengths operatively connected one each to the first and second connectors; or (b) a cable length operatively connected to one of the first and second connectors and a port with which the other of the first and second connectors is associated; and means cooperating between the at least one deformable component and first and second connectors to cause the at least one deformable component to be changed from the assembly state into the sealed state with the first and second connectors in the operative state to thereby define a seal to block migration of moisture to between the first and second connector parts.

18. The connecting assembly according to claim 17 wherein there are means cooperating between at least one of the connectors and the at least one deformable component to maintain the at least one of the connectors and at least one deformable component together as a unit with the first and second connectors fully separated from each other.

19. A sealing assembly for a cable connecting assembly, the sealing assembly comprising:

a ring-shaped moving element having a central axis and a shoulder facing in a first axial direction; and a deformable component having an annular shape, the deformable component residing in a receptacle bounded by a radially inwardly facing surface on the ring-shaped moving element and the shoulder so that the deformable component and ring-shaped moving element are maintained together as a unit, the ring-shaped moving element guidingly movable axially relative to one connector to which the ring-shaped moving element is connected and having a configuration to be joined into an operative relationship with another connector, the ring-shaped moving element causing the deformable component to be axially compressed between the shoulder and a part of one connector to which the ring-shaped element is connected so as to thereby deform radially to sealingly engage another connector to which one connector to which the ring-shaped element is connected can be joined.

20. The sealing assembly according to claim 19 wherein the ring-shaped moving element has threads to engage threads on one connector to which the ring-shaped moving element is connected.

21. The sealing assembly according to claim 20 further in combination with the one connector to which the ring-shaped moving element is connected.

22. The sealing assembly according to claim 21 wherein the one connector has a part with internal threads to engage another connector and external threads to engage the threads on the ring-shaped moving element.

23. The sealing assembly according to claim 19 wherein the deformable component comprises at least one of rubber and plastic.

24. The sealing assembly according to claim 22 further in combination with the another connector.

25. The sealing assembly according to claim 24 wherein the deformable component, ring-shaped moving element, and one connector are maintained together as a unit with the one connector fully separated from the another connector.

26. The sealing assembly according to claim 25 wherein the ring-shaped moving element is movable around the central axis relative to the one connector to thereby axially compress the deformable component.

27. The sealing assembly according to claim 26 wherein the deformable component has an annular inside surface with an effective diameter that is variable as an incident of the ring-shaped moving element being moved around the central axis relative to the one connector.

28. The sealing assembly according to claim 24 in combination with a coaxial cable operatively connected to one of the one and the another of the connectors.

29. A method of connecting a cable, the method comprising the steps of:

providing a first connector with a first connector part;

providing a sealing assembly on the first connector comprising a moving member and a deformable component;

operatively connecting a cable to the first connector so that a conductive path is defined through the cable and to the first connector;

providing a second connector with a second connector part;

joining the first and second connector parts to thereby place the first and second connectors into and maintain the first and second connectors in a joined operative state independently of the sealing assembly and thereby extend the conductive path to the second connector; and with the first and second connectors in the operative state moving the moving member to cause the deformable component to seal between the first and second connector parts.

30. The method of connecting a cable according to claim 29 wherein the step of providing a sealing assembly comprises providing a sealing assembly with a moving member that is threadably connected to the first connector part and the step of moving the moving member comprise turning the moving member around an axis relative to the first connector part.

31. The method of connecting a cable according to claim 29 wherein the step of moving the moving member to cause the deformable component to seal comprises moving the moving member to compress the deformable component between the moving member and the first connector part.

32. The method of connecting a cable according to claim 29 wherein the step of joining the first and second connector parts comprises joining the first and second connector parts with the first and second connector parts initially fully separated from each other and the sealing assembly maintained on the first connector.

33. The method of connecting a cable according to claim 29 wherein the step of providing a sealing assembly comprises providing a sealing assembly with a deformable component comprising at least one of plastic and rubber.

34. The method of connecting a cable according to claim 29 wherein the step of providing a sealing assembly comprises providing a sealing assembly with a ring-shaped moving member.

35. The method of connecting a cable according to claim 29 wherein the step of providing a sealing assembly comprises providing a sealing assembly with a ring-shaped moving member having a knurled surface and the step of moving the moving member comprises grasping the moving member at the knurled surface between a plurality of fingers of a user and turning the moving member around an axis.

36. The method of connecting a cable according to claim 29 wherein with the first and second connectors releasably fixedly maintained in the joined operative state through the cooperation of the first and second connector parts, the first and second connectors are prevented from being separated by the application of forces on the first and second connectors in axial opposite directions.

37. A method of connecting a cable, the method comprising the steps of:

providing a first connector with a first connector part;

providing a sealing assembly on the first connector comprising a moving member and a deformable component;

operatively connecting a cable to the first connector so that a conductive path is defined through the cable and to the first connector;

providing a second connector with a second connector part;

joining the first and second connector parts to thereby place the first and second connectors into a joined operative state and thereby extend the conductive path to the second connector; and with the first and second connectors in the operative state moving the moving member to cause the deformable component to seal between the first and second connector parts, wherein the second connector has an annular outside surface from which threads project and a part with contours spaced from the threads, the first connector has threads to engage the threads on the second connector to maintain the first and second connectors in a joined operative state and the step of moving the moving member comprises moving the moving member to cause the deformable component to conform to the contours on the part of the annular outside surface.

* * * * *